US011839786B2

(12) United States Patent
Lagree et al.

(10) Patent No.: US 11,839,786 B2
(45) **Date of Patent: *Dec. 12, 2023**

(54) EXERCISE MACHINE RESISTANCE ADJUSTMENT SYSTEM

(71) Applicant: Lagree Technologies, Inc., Chatsworth, CA (US)

(72) Inventors: Sebastien Anthony Louis Lagree, Chatsworth, CA (US); Samuel D. Cox, Yuba City, CA (US); Todd G. Remund, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/063,831

(22) Filed: Dec. 9, 2022

(65) Prior Publication Data

US 2023/0095060 A1 Mar. 30, 2023

Related U.S. Application Data

(63) Continuation of application No. 17/514,101, filed on Oct. 29, 2021, now Pat. No. 11,524,197, which is a (Continued)

(51) Int. Cl.
*A63B 21/00* (2006.01)
*A63B 21/02* (2006.01)
(Continued)

(52) U.S. Cl.
CPC ..... *A63B 21/00069* (2013.01); *A63B 21/023* (2013.01); *A63B 21/0428* (2013.01); (Continued)

(58) Field of Classification Search
CPC ..... A63B 21/00069; A63B 22/0002; A63B 22/0089; A63B 23/0405; A63B 21/023; (Continued)

(56) References Cited

U.S. PATENT DOCUMENTS 131,886 A 10/1872 Little
1,621,477 A 3/1927 Pilates
(Continued)

FOREIGN PATENT DOCUMENTS

WO 2004096376 A1 11/2004

OTHER PUBLICATIONS

Picture of a Product Developed by the Inventor, Sebastien Lagree; 2007.

(Continued)

*Primary Examiner* — Garrett K Atkinson
(74) *Attorney, Agent, or Firm* — Neustel Law Offices

(57) ABSTRACT

An exercise machine resistance adjustment system for providing an exerciser the ability to immediately adjust the resistance force by changing their body position on the movable carriage or end platforms. The exercise machine resistance adjustment system generally includes a frame, a carriage movably positioned on the frame, a spring connected to the carriage to apply a biasing force to the carriage, one or more left projections within the carriage adapted for a left hand of an exerciser to grasp, and one or more right projections within the carriage adapted for a right hand of an exerciser to grasp. The exerciser is able to efficiently adjust the amount of resistance force applied to the carriage by repositioning their hands (or feet) from a first set of projections at a first distance to a second set of projections at a second distance from the first end of the exercise machine.

20 Claims, 7 Drawing Sheets

Related U.S. Application Data continuation of application No. 16/921,380, filed on Jul. 6, 2020, now Pat. No. 11,161,001, which is a continuation of application No. 16/273,056, filed on Feb. 11, 2019, now Pat. No. 10,702,730, which is a continuation of application No. 15/871,540, filed on Jan. 15, 2018, now Pat. No. 10,201,724, which is a continuation of application No. 15/413,385, filed on Jan. 23, 2017, now Pat. No. 9,868,011.

(60) Provisional application No. 62/438,542, filed on Dec. 23, 2016, provisional application No. 62/281,899, filed on Jan. 22, 2016.

(51) Int. Cl.

| | |
|---|---|
| ***A63B 21/04*** | (2006.01) |
| ***A63B 22/00*** | (2006.01) |
| ***A63B 23/04*** | (2006.01) |
| ***A63B 23/12*** | (2006.01) |
| ***A63B 71/06*** | (2006.01) |
| ***A63B 21/055*** | (2006.01) |
| ***A63B 21/005*** | (2006.01) |
| ***A63B 21/008*** | (2006.01) |
| ***A63B 21/045*** | (2006.01) |
| ***A63B 22/20*** | (2006.01) |

(52) U.S. Cl.

CPC ..... *A63B 21/055* (2013.01); *A63B 21/4034* (2015.10); *A63B 21/4035* (2015.10); *A63B 21/4045* (2015.10); *A63B 22/0002* (2013.01); *A63B 22/0089* (2013.01); *A63B 23/0405* (2013.01); *A63B 23/12* (2013.01); *A63B 71/06* (2013.01); *A63B 21/005* (2013.01); *A63B 21/00065* (2013.01); *A63B 21/0083* (2013.01); *A63B 21/0087* (2013.01); *A63B 21/045* (2013.01); *A63B 21/0552* (2013.01); *A63B 22/001* (2013.01); *A63B 22/0007* (2013.01); *A63B 22/203* (2013.01); *A63B 2071/0694* (2013.01)

(58) Field of Classification Search

CPC . A63B 21/4034; A63B 21/4045; A63B 71/06; A63B 23/12; A63B 21/0428; A63B 21/055; A63B 21/4035; A63B 21/005; A63B 22/203; A63B 21/0087; A63B 21/0083; A63B 22/0007; A63B 21/00065; A63B 2071/0694; A63B 21/045; A63B 22/001; A63B 21/0552; A63B 2071/069

See application file for complete search history.

(56) References Cited

U.S. PATENT DOCUMENTS 1,866,868 A 7/1932 Thomson
2,223,309 A 4/1940 Swanson
3,589,720 A * 6/1971 Agamian ..... A63B 22/203 482/114
3,746,338 A * 7/1973 Proctor ..... A63B 21/063 482/38
3,770,267 A 11/1973 McCarthy
3,795,396 A 3/1974 Kropeinitski
3,806,094 A 4/1974 Harken
4,111,417 A * 9/1978 Gardner ..... A63B 23/03533 482/130
4,231,375 A 11/1980 Boehringer
4,541,627 A * 9/1985 MacLean ..... A63B 22/0076 482/73
4,620,701 A 11/1986 Mojden
4,650,184 A * 3/1987 Brebner ..... A63B 69/18 482/71
4,695,050 A * 9/1987 Smith ..... A63B 22/0076 482/73
4,706,953 A 11/1987 Graham
4,709,918 A * 12/1987 Grinblat ..... A63B 22/203 482/118
4,709,920 A 12/1987 Schnell
4,756,523 A * 7/1988 Rasmussen ..... A63B 22/0076 482/73
4,759,540 A 7/1988 Yu
4,798,378 A 1/1989 Jones
4,845,987 A 7/1989 Kenneth
4,865,317 A * 9/1989 Hickey ..... A63B 21/05 482/126
4,911,438 A 3/1990 Van Straaten
4,915,377 A * 4/1990 Malnke ..... A63B 23/03525 482/99
5,007,632 A 4/1991 Wilkinson
5,064,189 A * 11/1991 Shiuh-Shinn ..... A63B 21/027 482/128
5,066,005 A * 11/1991 Luecke ..... A63B 23/00 482/145
5,072,929 A * 12/1991 Peterson ..... A63B 22/0012 310/105
5,108,093 A * 4/1992 Watterson ..... A63B 22/0012 482/73
5,139,471 A 5/1992 Domberger
5,179,746 A 1/1993 Rogers
5,211,617 A 5/1993 Millen
5,263,913 A 11/1993 Boren
5,295,935 A * 3/1994 Wang ..... A63B 21/4033 482/130
5,358,462 A 10/1994 Calderone
5,374,226 A 12/1994 Grahm
5,380,259 A 1/1995 Robertson
5,429,567 A 7/1995 Gerschefske
D362,700 S 9/1995 Breibart
5,503,609 A * 4/1996 Bull ..... A63B 69/0022 482/70
D382,319 S 8/1997 Gerschefske
5,681,249 A 10/1997 Endelman
5,833,558 A 11/1998 Connelly, III
5,857,946 A 1/1999 Brown
5,885,197 A 3/1999 Barton
5,967,955 A 10/1999 Westfall
5,997,450 A 12/1999 Wilkinson
6,042,523 A 3/2000 Graham
6,045,491 A 4/2000 McNergney
6,071,217 A * 6/2000 Barnett ..... A63B 22/205 482/121
6,179,753 B1 1/2001 Barker
6,280,366 B1 * 8/2001 Hsieh ..... A63B 21/4045 482/130
6,315,695 B1 11/2001 Follett
6,440,045 B1 * 8/2002 Gaston ..... A63B 21/012 482/91
6,461,283 B1 10/2002 Maron
6,527,685 B2 * 3/2003 Endelman ..... A63B 21/023 482/121
6,634,996 B2 * 10/2003 Jacobsen ..... A63B 21/0628 482/142
6,652,425 B1 11/2003 Martin
6,786,850 B2 * 9/2004 Nizamuddin ..... A63B 69/0022 482/70
6,817,968 B2 * 11/2004 Galbraith ..... A63B 21/0552 482/121
6,981,932 B1 * 1/2006 Huang ..... A63B 21/4035 482/121
7,090,621 B2 * 8/2006 Loane ..... A63B 21/4007 482/71
7,163,500 B2 1/2007 Endelman
7,294,098 B2 * 11/2007 Barnard ..... A63B 22/203 482/121
7,419,459 B2 * 9/2008 Van Straaten ..... A63B 22/14 482/146
7,438,673 B1 * 10/2008 Jones ..... A63B 23/0488 482/907

(56) References Cited

U.S. PATENT DOCUMENTS 7,654,941 B2 * 2/2010 Lacher ..... A63B 21/0622 482/135
7,803,095 B1 * 9/2010 LaGree ..... A63B 22/0089 482/121
7,806,805 B2 * 10/2010 Barufka ..... A63B 21/02 482/121
7,819,777 B1 10/2010 Service
7,931,570 B2 4/2011 Hoffman
7,942,799 B1 5/2011 Boyd
7,967,736 B2 * 6/2011 D'Silva ..... A63B 22/001 482/121
D659,205 S 5/2012 Endelman
8,249,714 B1 8/2012 Hartman
8,430,800 B2 * 4/2013 Nolan ..... A63B 23/0405 482/121
8,500,611 B2 * 8/2013 Hoffman ..... A63B 23/03533 482/129
8,585,554 B2 11/2013 Shavit
8,613,692 B2 12/2013 Baudhuin
8,641,585 B2 * 2/2014 LaGree ..... A63B 22/203 482/92
8,721,511 B2 * 5/2014 Endelman ..... A63B 21/4035 482/121
8,834,332 B2 * 9/2014 Campanaro ..... A63B 21/0628 482/142
8,894,551 B2 * 11/2014 Kerdjoudj ..... A63B 21/0557 482/70
8,961,373 B2 * 2/2015 Halver ..... A63B 21/4047 482/52
9,022,909 B2 * 5/2015 Kermath ..... A63B 21/0428 482/133
9,072,931 B2 * 7/2015 Lagree ..... A63B 21/4045
9,079,071 B2 * 7/2015 Allain ..... A63B 21/0428
9,119,989 B1 9/2015 Lagree
9,138,606 B2 9/2015 Lagree
9,180,332 B1 * 11/2015 Tenorio ..... A63B 21/055
9,211,440 B2 12/2015 Lagree
9,283,422 B2 * 3/2016 Lagree ..... A63B 21/0557
9,289,645 B2 * 3/2016 Masterson ..... A63B 21/055
9,370,679 B2 6/2016 Lagree
9,393,454 B2 * 7/2016 Lagree ..... A63B 22/0089
D764,606 S 8/2016 Lagree
9,415,253 B2 * 8/2016 Lagree ..... A63B 21/4035
9,457,216 B2 10/2016 Lagree
9,457,225 B2 10/2016 Lagree
9,474,924 B2 10/2016 Lagree
9,474,926 B1 10/2016 Lagree
9,474,927 B2 10/2016 Lagree
D772,992 S 11/2016 Lagree
9,498,667 B1 * 11/2016 Lagree ..... A63B 23/04
9,517,375 B2 12/2016 Lagree
9,522,299 B2 12/2016 Lagree
9,533,184 B1 1/2017 Lagree
9,533,185 B1 1/2017 Lagree
9,545,535 B2 1/2017 Lagree
9,555,282 B1 1/2017 Lagree
9,579,536 B1 2/2017 Lagree
9,579,555 B2 2/2017 Lagree
9,586,081 B2 3/2017 Lagree
9,586,089 B2 3/2017 Lagree
9,597,545 B1 3/2017 Lagree
9,604,095 B1 * 3/2017 Lagree ..... A63B 23/03508
9,604,097 B1 3/2017 Lagree
D785,104 S 4/2017 Lagree
D789,463 S 6/2017 Lagree
9,700,754 B2 7/2017 Lagree
9,789,354 B2 * 10/2017 Lagree ..... A63B 22/0023
9,808,664 B2 11/2017 Lagree
9,868,009 B2 1/2018 Lagree
9,868,019 B2 1/2018 Lagree
9,981,156 B2 5/2018 Lagree
10,046,193 B1 8/2018 Aronson
10,052,518 B2 8/2018 Lagree
10,109,216 B2 10/2018 Lagree
10,213,641 B2 * 2/2019 Lagree ..... A63B 21/4034
10,279,207 B2 5/2019 Lagree
10,500,441 B2 12/2019 Lagree
2001/0056011 A1 12/2001 Endelman
2002/0058573 A1 * 5/2002 Endelman ..... A63B 21/055 482/142
2003/0119635 A1 6/2003 Arbuckle
2004/0009849 A1 * 1/2004 Galbraith ..... A63B 22/0076 482/51
2004/0043873 A1 3/2004 Wilkinson
2004/0142800 A1 7/2004 Gerschefske
2005/0085357 A1 4/2005 Endelman
2005/0124471 A1 6/2005 Wilkinson
2005/0130810 A1 6/2005 Sands
2005/0164856 A1 7/2005 Parmater
2006/0046914 A1 3/2006 Endelman
2006/0199712 A1 9/2006 Barnard
2007/0087921 A1 4/2007 Graham
2007/0117693 A1 5/2007 Illioi
2007/0129226 A1 6/2007 Leavitt
2007/0219053 A1 9/2007 Barufka
2008/0070765 A1 3/2008 Brown
2008/0248935 A1 10/2008 Solow
2009/0111661 A1 4/2009 Hauser
2009/0118108 A1 5/2009 Uygan
2010/0227748 A1 9/2010 Campanaro
2011/0009249 A1 1/2011 Campanaro
2011/0130258 A1 6/2011 Gerschefske
2011/0143898 A1 6/2011 Trees
2011/0152036 A1 * 6/2011 Halver ..... A63B 21/157 482/51
2011/0166002 A1 7/2011 Savsek
2011/0172069 A1 7/2011 Gerschefske
2012/0295771 A1 11/2012 Lagree
2013/0017935 A1 1/2013 Endelman
2013/0196835 A1 8/2013 Solow
2013/0281269 A1 10/2013 Gerschefske
2014/0011645 A1 1/2014 Johnson
2014/0100089 A1 4/2014 Kermath
2014/0121076 A1 5/2014 Lagree
2014/0121078 A1 5/2014 Lagree
2014/0121079 A1 * 5/2014 Lagree ..... A63B 21/00065 482/139
2014/0141948 A1 5/2014 Aronson
2014/0221182 A1 * 8/2014 Lin ..... A63B 23/03525 482/142
2015/0024914 A1 1/2015 Lagree
2015/0057127 A1 2/2015 Lagree
2015/0065318 A1 3/2015 Lagree
2015/0065320 A1 3/2015 Anderson
2015/0072841 A1 3/2015 Lagree
2015/0141204 A1 5/2015 Lagree
2015/0217164 A1 8/2015 Lagree
2015/0220523 A1 8/2015 Lagree
2015/0246258 A1 * 9/2015 Hockridge ..... A63B 21/156 482/99
2015/0246263 A1 9/2015 Campanaro
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree

(56) References Cited

U.S. PATENT DOCUMENTS

| | | | |
|---|---|---|---|
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0113091 | A1 | 4/2017 | Lagree |
| 2020/0222741 | A1 | 7/2020 | Aronson |

OTHER PUBLICATIONS

Picture of Proformer Exercise Machine; Dec. 31, 2008.
https://web.archive.org/web/20100501142110/http:/spxfitness.com/index.php?option=com_content&view=article&id=32&Itemid=3; SPX Fitness Superformer Wayback Machine Archive.org Page, May 1, 2010.
Pictures of Megaformer M2 Exercise Machine Developed by the Inventor Sebastien Lagree; Jan. 1, 2011.
Pictures of Megaformer Product Developed by the Inventor, Sebastien Lagree, Printed and Received Feb. 4, 2011.
https://web.archive.org/web/20121205030242/http:/www.lagreefitness.com:80/index.php?option=com_content&view=article&id=32&Itemid=3; Lagree Fitness Wayback Machine Archive.org Page; Dec. 5, 2012.
https://web.archive.org/web/20160405173247/http://static.flickr.com/8480/8186598268_8390c9bc08_b.jpg; MegaFormer M3 Picture Wayback Machine Archive.org Page; Dec. 5, 2012.
https://twitter.com/LagreeFitness/status/635822521997242369; "Can you handle the Supraformer?" (@LAGREEFITNESS) Twitter Post; Aug. 24, 2015.
https://twitter.com/LagreeFitness/status/636555280218615808; "Los Angeles: Get ready for a one of kind workout!" (@LAGREEFITNESS) Twitter Post; Aug. 26, 2015.
PCT International Search Report and Written Opinion for PCT/US2016/58178; dated Jan. 13, 2017.
Pictures of Megaformer M3 Exercise Machine Developed by Inventor, Sebastien Lagree; dated Dec. 15, 2012.

* cited by examiner

EXERCISE MACHINE RESISTANCE ADJUSTMENT SYSTEM

CROSS REFERENCE TO RELATED APPLICATIONS

The present application is a continuation of U.S. application Ser. No. 17/514,101 filed on Oct. 29, 2021 which issues as U.S. Pat. No. 11,524,197 on Dec. 13, 2022, which is a continuation of U.S. application Ser. No. 16/921,380 filed on Jul. 6, 2020 now issued as U.S. Pat. No. 11,161,001, which is a continuation of U.S. application Ser. No. 16/273,056 filed on Feb. 11, 2019 now issued as U.S. Pat. No. 10,702,730, which is a continuation of U.S. application Ser. No. 15/871,540 filed on Jan. 15, 2018 now issued as U.S. Pat. No. 10,201,724, which is a continuation of U.S. application Ser. No. 15/413,385 filed on Jan. 23, 2017 now issued as U.S. Pat. No. 9,868,011, which claims priority to U.S. provisional patent application Ser. No. 62/281,899 filed Jan. 22, 2016 and U.S. provisional patent application Ser. No. 62/438,542 filed Dec. 23, 2016. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine resistance adjustment system for providing an exerciser the ability to immediately adjust the resistance force by changing their body position on the movable carriage or end platforms.

Related Art

Any discussion of the related art throughout the specification should in no way be considered as an admission that such related art is widely known or forms part of common general knowledge in the field.

Resistance is widely used in various fitness and strength training equipment, and is well known throughout the fitness industry worldwide. Resistance fitness products typically use a resistance element, such as elastic bands or springs that create a resistance force. An exerciser creates a greater opposing force in order to stretch or compress the resistance element. The exercise equipment may be exceedingly simple, such as an elastomeric tube with hand grips on each end, to rubber balls that are squeezed repeatedly as a grip strengthening device.

On the other hand, more complex equipment incorporates a plurality of resistance elements that provide the exerciser with many choices of resistance levels. For example, in a traditional Pilates machine, one or more extension springs are attached between the carriage and one stationary end of the apparatus, thereby creating a variable resistance force biasing the carriage towards the stationary end of the apparatus to which the springs are attached. During an exercise, a person places all or part of their body on the carriage, and uses muscle force to overcome the spring resistance force, thereby moving the carriage in a direction opposed to the stationary spring end.

In practice, an exerciser attaches one or more springs between the carriage and stationary end of the apparatus, the number of springs approximating the desired force against which to perform resistance exercises. In all of the foregoing equipment just described, in order to change the resistance level, an exerciser must stop their exercising, and change equipment, or change the number of resistance elements against which they are exercising.

SUMMARY

An example embodiment is directed to an exercise machine resistance adjustment system. The exercise machine resistance adjustment system includes a frame, a carriage movably positioned on the frame, a spring connected to the carriage to apply a biasing force to the carriage, one or more left projections within the carriage adapted for a left hand of an exerciser to grasp, and one or more right projections within the carriage adapted for a right hand of an exerciser to grasp. The exerciser is able to efficiently adjust the amount of resistance force applied to the carriage by repositioning their hands (or feet) from a first set of projections at a first distance to a second set of projections at a second distance from the first end of the exercise machine.

Hooke's Law is a principle of physics that states that the force needed to extend a spring by some given distance is proportional to that distance. Therefore, extending the spring further increases the resistance force required to overcome the proportionally higher force, and conversely, reducing the distance that the spring is extended reduces the resistance force required.

The various embodiments of the present invention provide for body repositioning on an exercise machine as a means to incrementally increase or decrease the workout resistance level without having to interrupt exercising in order to change the type of number of resistance elements against which they are exercising. Some of the various embodiments illustrate positioning pockets or slots sized appropriately to accommodate an exerciser's hands or feet, the features placed at various positions on the slidable or stationary platforms along the longitudinal axis of an exercise machine that uses a slidable platform resistance biased toward one end of the machine. The positioning pockets and slots could be considered analogous to variably positioned rungs on a ladder. By easily moving the hands or feet from one rung to another during mid-exercise, the exerciser can quickly increase or decrease the travel distance of the carriage during any given exercise, and therefore the adjust the exercise resistance without stopping the exercise to add or remove springs.

There has thus been outlined, rather broadly, some of the embodiments of the exercise machine resistance adjustment system in order that the detailed description thereof may be better understood, and in order that the present contribution to the art may be better appreciated. There are additional embodiments of the exercise machine resistance adjustment system that will be described hereinafter and that will form the subject matter of the claims appended hereto. In this respect, before explaining at least one embodiment of the exercise machine resistance adjustment system in detail, it is to be understood that the exercise machine resistance adjustment system is not limited in its application to the details of construction or to the arrangements of the components set forth in the following description or illustrated in the drawings. The exercise machine resistance adjustment system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

An example exercise machine resistance adjustment system generally comprises a frame, a carriage movably positioned on the frame, a spring connected to the carriage to apply a biasing force to the carriage, one or more left projections within the carriage adapted for a left hand of an exerciser to grasp, and one or more right projections within the carriage adapted for a right hand of an exerciser to grasp. The exerciser is able to efficiently adjust the amount of resistance force applied to the carriage by repositioning their hands (or feet) from a first set of projections at a first distance to a second set of projections at a second distance from the first end of the exercise machine.

Figure 1:
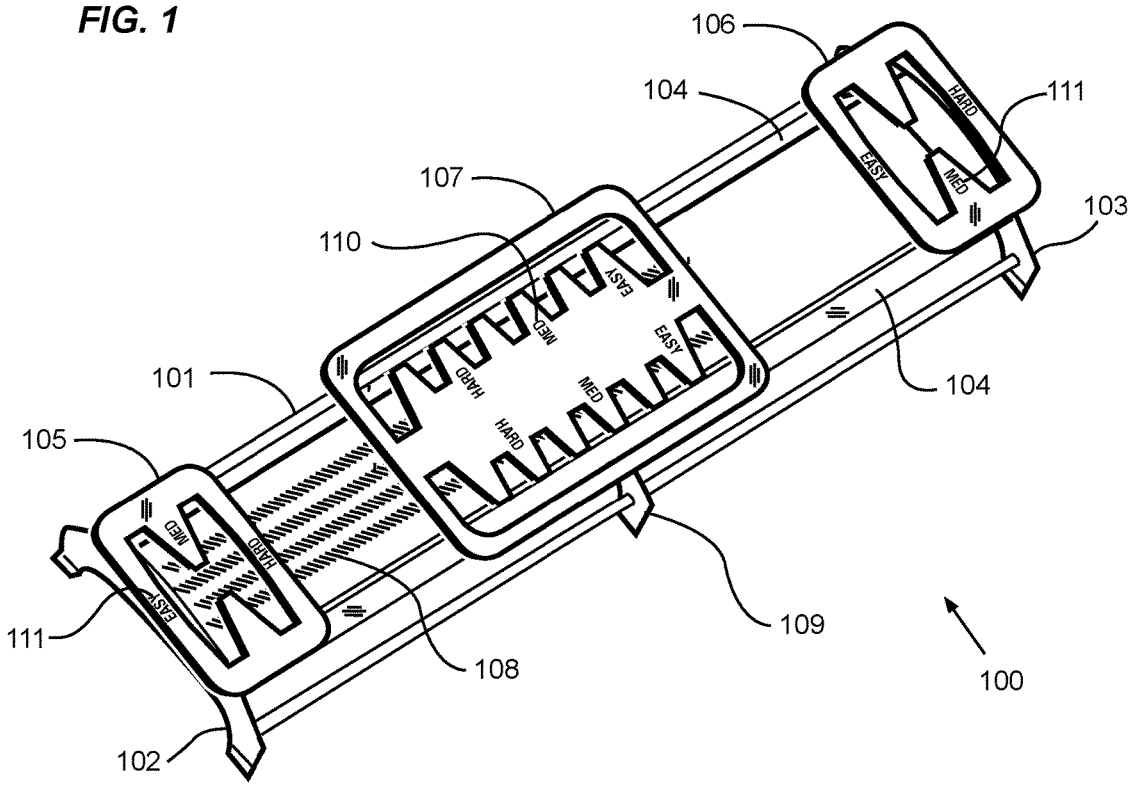
FIG. 1 is a perspective view of an exercise machine resistance adjustment system in accordance with an example embodiment.

FIG. 1 is a perspective view of an exercise machine 100 in accordance with an example embodiment. A substantially longitudinal frame 101 is comprised of at least one rail (e.g. a pair of parallel rails 104) connected to vertical supports at a first end 102, and a second end 103. An interstitial vertical support 109 is shown positioned approximately half the distance between the first and second supports.

A first stationary exercise end platform 105 is attached to the frame substantially at or near the first end of the frame 101, and a second stationary exercise end platform 106 is affixed substantially at or near the second end of the frame 101. A third slidable platform or carriage 107 is movably positioned between the first and second platforms, and is slidable therebetween upon the one or more rails 104. It should be noted that certain indicia, which will be later described is provided as carriage indicia 110 and stationary platform indicia 111.

One or more springs 108 are preferably removably attached between the frame 101 (e.g. the first end 102 of the frame 101) and the carriage 107, thereby creating a spring resistance bias on the carriage 107. The springs 108 are removably attachable to the carriage 107 to allow for adjustment of the total resistance force applied to the carriage 107. The springs 108 may be comprised of various types of springs such as, but not limited to, coil springs, metal coil springs, tension springs, compression springs, gas springs, air springs, helical springs, torsion springs, elastic bands, rubber bands, linear actuators, electromagnetic resistance and the like. The springs 108 may be substantially straight between the frame 101 and the carriage 107, or alternatively, pulleys may be used to redirect the force of the springs 108. U.S. Pat. No. 7,803,095 to Lagree and U.S. Pat. No. 9,283,422 to Lagree illustrate exemplary spring biasing systems suitable for use with the various embodiments and are hereby incorporated by reference herein. As the carriage 107 is moved away from first end or second end of the exercise machine, the carriage 107 pulls upon the connected spring(s) 108 such that the resistance force applied to the carriage 108 by the springs increases as the carriage 108 is moved away from the first end of the exercise machine. The further the carriage 107 is moved away from the first end of the exercise machine, the higher the level of resistance force is applied to the carriage 107 by the springs 108. As the carriage 107 is moved back towards the first end of the exercise machine, the resistance force correspondingly decreases until the carriage 107 is fully returned to its initial start position near the first end of the exercise machine.

Figure 2:
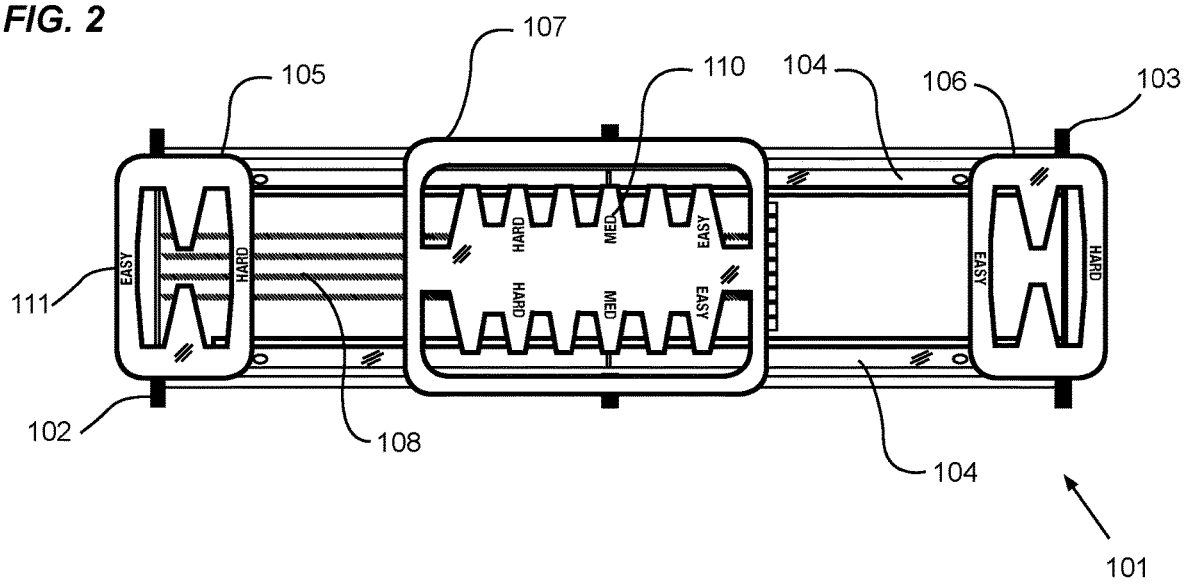
FIG. 2 is a top view of an exercise machine resistance adjustment system in accordance with an example embodiment.

FIG. 2 is a top view of an exercise machine 100. A substantially longitudinal frame is comprised of a pair of parallel rails 104 connected to vertical supports at a first end 102, and a second end 103. A first stationary exercise end platform 105 is affixed substantially at a first end of the apparatus, and a second stationary exercise end platform 106 is affixed substantially at a second end. A third platform 107 is positioned between the first and second platforms, and is slidable therebetween upon the parallel rails 104. One or more springs 108 are removably attached between the first end 102 and the carriage 107, thereby creating a spring resistance bias on the carriage 107. Carriage indicia 110 and stationary platform indicia 111 which will be fully described herein are provided as a means of indicating certain body positions upon the exercise machine that increases or decreases the exercise resistance during an exercise.

Figure 3:
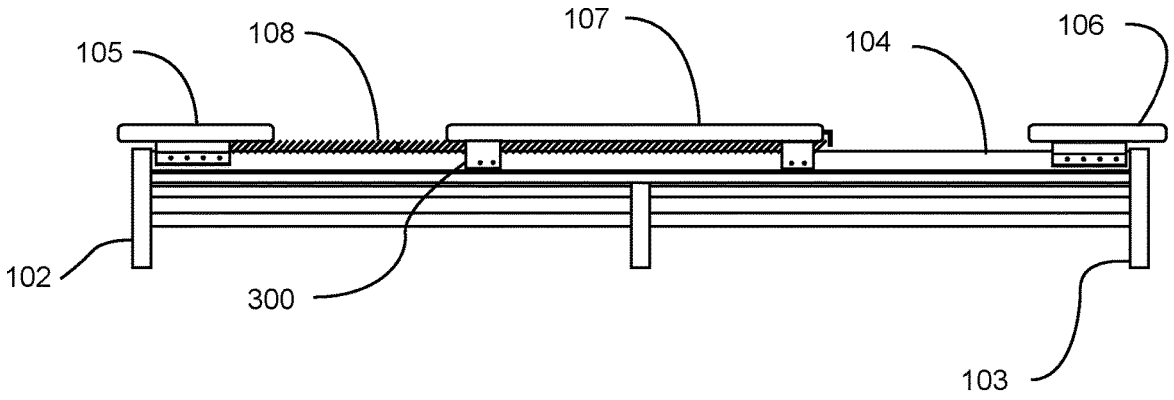
FIG. 3 is a side view of an exercise machine resistance adjustment system in accordance with an example embodiment

FIG. 3 is a side view of an exercise machine 100. One or more springs 108 are removably attached between the first end 102 and a carriage 107 slidable upon a pair of parallel rails 104, thereby creating a spring resistance bias on the carriage 107. A trolley system 300 affixed to the carriage 107 provides for the platform to slide substantially the length of the apparatus between a first end platform 105 and a second end platform 106. A spring biasing means 108 creates a resistance force between the carriage 107 and a first end 102. The spring biasing force between the carriage and a first end is determined by the number of springs attached therebetween, and the K factor of those springs.

Figure 4:
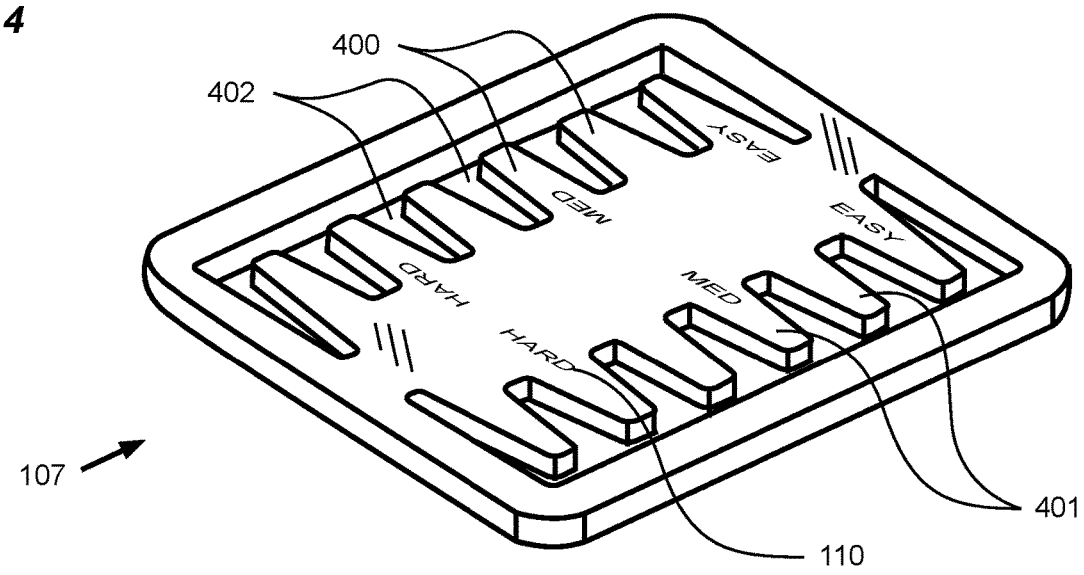
FIG. 4 is a perspective view of a slidable platform or carriage in accordance with an example embodiment.

FIG. 4 is a perspective view of a carriage 107. One or more projections 400 extend laterally from a substantially closed longitudinal center of the carriage 107, with each of the projections 400 on one side of the platform substantially aligned with each of the projections 401 on the opposed side of the platform forming two horizontal rows of projections 400. The projections 400 may be tapered, curved, straight or other types of shapes that are ergonomic for the exercise to grasp with their hands or engage with their feet. While a single row of projections 400 may be used, it is preferable to use two opposing rows of projections 400 that are on opposite sides of a longitudinal center axis of the frame of the exercise machine. The projections 400 form handles that are adapted for grabbing with the hands of the user or direct physical contact with other portions of the body of the exerciser (e.g. the feet, knees and the like). The spaces 402 between the adjacent projections have a primary central axis transverse to the longitudinal axis of the apparatus, and are of sufficient size to accommodate the insertion of a foot between the projections, or to allow a hand to grip any projection. The number of projections on each side of the platform are positioned at a predetermined space forming at least two spaces on each side. The at least two spaces provide for an exerciser to move their hands or feet between the at least two spaces as a means to increase or decrease the longitudinal travel of the carriage, and correspondingly the resistance forces exerted upon the carriage during the performance of a given exercise. Indicia 110 are provided on the exercise surface of the carriage, on one hand correctly readable on the right hand side of the platform when an exerciser is facing towards a first distal end of the exercise machine, and on the other hand correctly readable on the right hand side of the platform when an exerciser is facing towards the opposed distal end of the exercise machine. The carriage 107 further includes a perimeter portion that surrounds the projections 400 and the spaces 402 defining a first longitudinal slot and a second longitudinal slot that extend substantially parallel with respect to the longitudinal axis of the exercise machine as best illustrated in FIGS. 9A through 9F of the drawings. The perimeter portion of the carriage 107 forms a left side handle, a right side handle, a pair of first end handles and a pair of second end handles that are opposite of the first end handles for the exerciser to engage with their body (e.g. grasping with hands). The perimeter portion of the carriage 107 preferably has a rectangular shape as shown in FIGS. 9A through 9F of the drawings, however, various other shapes may be used to form the perimeter portion of the carriage 107. The projections 901 may extend inwardly from the perimeter portion of the carriage 107 instead of outwardly from a central portion of the carriage 107.

Figure 5:
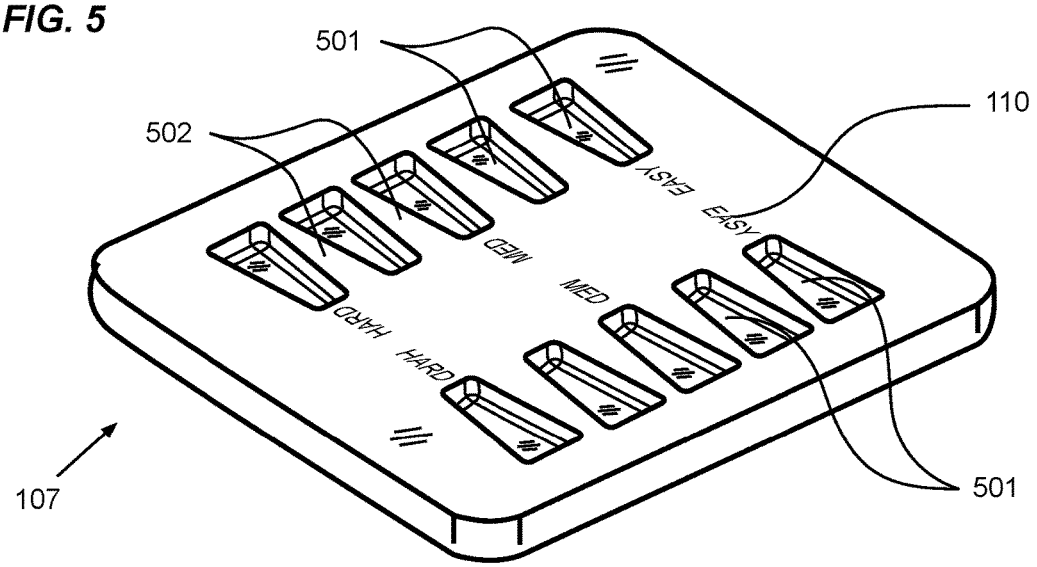
FIG. 5 is a perspective view of a slidable platform or carriage in accordance with an example embodiment.

FIG. 5 is a perspective view of another alternate version of a carriage 107. In this variation of the platform FIG. 4 just described, the at least two recessed pockets 501 with substantially vertical walls extending from the bottom (i.e. floor) of the pockets to the top surface of the carriage. The pockets are aligned with their central longitudinal axis substantially transverse to the longitudinal axis of the apparatus, are sized so that an exerciser's feet or fingers can be placed within the pocket, and are spaced apart at such a distance such that the ridge 502 between the pockets acts as a handle that an exerciser may grip by placing a thumb in a first pocket, and the fingers of the hand in the adjacent pocket.

Further, each pocket is of a sufficient size and orientation to allow the toes of a foot to be placed against the pocket bottom surface, with the balls of the foot resting against the substantially vertical wall transverse to the longitudinal axis of the apparatus. An exerciser therefore, placing a foot in the pocket as just described may extend the foot, pushing against the substantially vertical wall of the pocket as a means to move the slidable carriage in a direction opposed to the spring induced resistance. The ridges formed as a separator between each of the pockets may also be ribs that are raised above the top surface of the carriage as another means of creating gripping handles or ridged against which an exerciser may push against with their foot.

Indicia 110 are provided on the exercise surface of the carriage proximate to the selectable pockets just described, on one hand the indicia being correctly readable on the right hand side of the platform when an exerciser is facing towards a first distal end of the exercise machine, and on the other hand the indicia being correctly readable on the right hand side of the platform when an exerciser is facing towards the opposed distal end of the exercise machine.

Figure 6A:
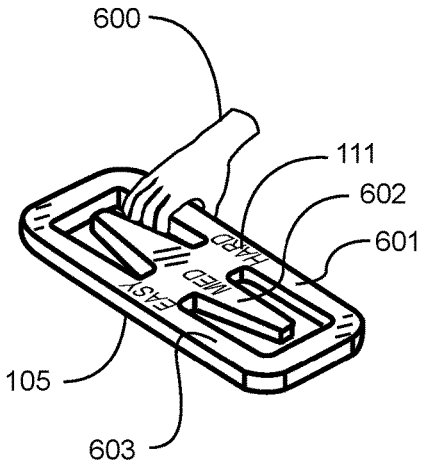
FIGS. 6A-6C are perspective views showing variable hand positions on a stationary end platform in accordance with an example embodiment.

FIG. 6A is an exemplary diagram showing the hand position on a stationary platform 105. As shown in FIG. 6A, an opening is shown on both sides of the platform surface thereby creating at least two hand grips on each side of the platform. A representative hand of an exerciser is shown gripping a first hand gripping surface 601 by placing the fingers through the just described opening. The central axis of the gripping surface is substantially aligned transverse to the longitudinal axis of the apparatus not shown, but to which the platform is securedly attached. A second gripping surface 602, and a third gripping surface 603 are shown on each side of the platform, all of the gripping surfaces created by the introduction of openings positioned laterally and transverse to the central longitudinal axis of the apparatus.

Stationary platform indicia 111 is shown on the first gripping surface 601, the word "hard" indicating that by gripping this surface, the peak exercise resistance will be harder during exercise than gripping the third gripping surface 603, which, as the indicia "easy" would indicate as a lower peak resistance level during exercise.

It should be noted that the indicia as illustrated in the drawings is not limited to use of the words "hard, med, easy", but may use any combination of words, numbers or colors that would communicate to the exerciser that use of one gripping surface during exercise would result in an increased or decreased resistance level with respect to the other available gripping surfaces.

Figure 6B:
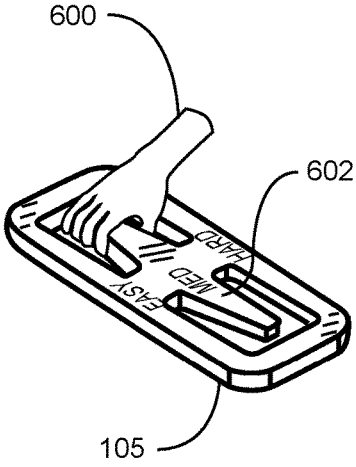

FIG. 6B shows the exerciser's hand 600 has been moved from the gripping surface just described to a second position wherein the hand 600 is now shown gripping a second surface 602, a laterally projecting structure formed by the introduction of the openings configured on both sides of the platform 105. The indicia "MED" is shown proximate to the second gripping surface indicating that the resistance level during exercise by gripping the instant gripping surface will be lower than gripping the first gripping surface 601. As the exerciser's hand position moves in a direction towards the first end of the apparatus not shown, and provided that the exerciser does not re-position other parts of the body in contact with the carriage, the range of motion of the carriage, and therefore the resistance force exerted by the spring biasing means, is reduced proportional to the distance the hands have moved from the first gripping surface 601 to the second gripping surface 602.

Figure 6C:
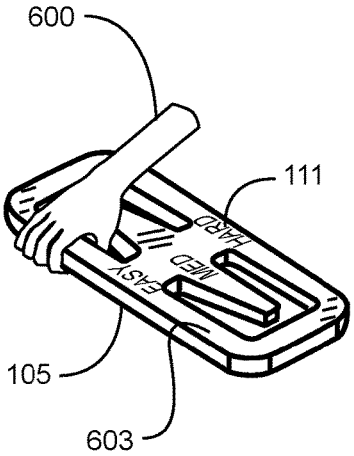

FIG. 6C shows the exerciser's hand having been moved to a third gripping surface 603. When compared to gripping either the first gripping surface 601, or the second gripping surface 602, the exercise resistance force during the performance of an exercise is reduced compared to gripping the first and/or second gripping surfaces as just described FIG. 6B, the exerciser's instant hand 600 position having moved in a direction towards the first end of the apparatus further reduces the range of travel of the carriage, and correspondingly has further reduced the instant maximum resistance force against which the exerciser must work.

It should be noted that the openings on the stationary platform, while first providing for hand gripping surfaces, and also sufficiently large enough for an exerciser in the substantially prone position to insert the lower portion of their foot into the opening so that they may push on each of the substantially vertical surfaces of the gripping surfaces 601, 602, 603, proximate to the carriage to increase or decrease the range of travel of the carriage, and correspondingly increase or decrease the resistance level encountered during the exercise. The multi-gripping positions provide for instant resistance level changes during the performance of an exercise when the exerciser quickly relocates their hands or feet on the various gripping surfaces of projections as just described.

Figure 7A:
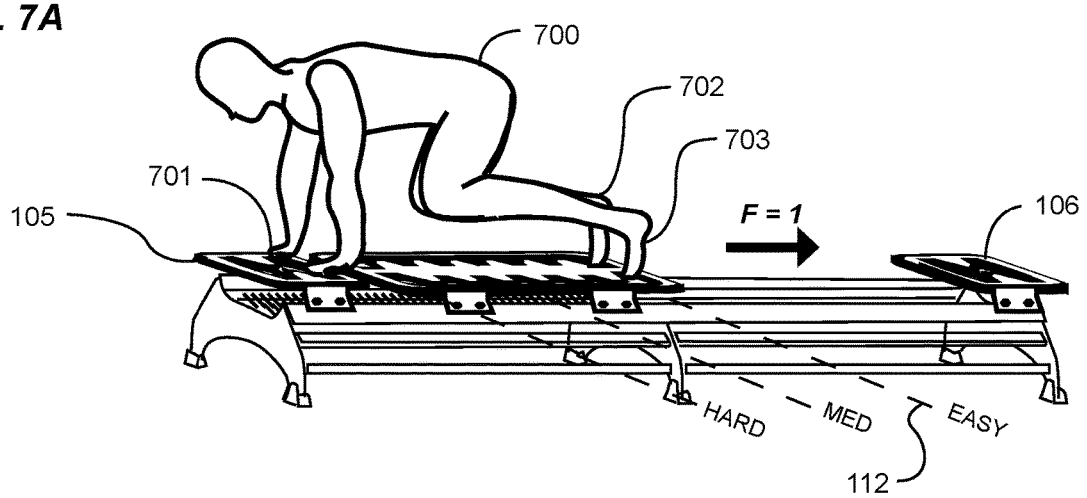
FIGS. 7A-7C are perspective views showing variable foot positions on a slidable platform or carriage in accordance with an example embodiment.

FIG. 7A is an exemplary diagram showing the foot position on a carriage 107 at the start of an exercise. In this exercise, workout emphasis is placed on the core abdominal and lower body muscles, and secondarily work the back and shoulders.

In the drawing, a representative exerciser 700 is positioned facing downward towards an exercise apparatus with the feet 702, 703 placed in the openings distal to the stationary platform 105, the openings having their longitudinal central axis substantially transverse to the longitudinal axis of the apparatus. In determining foot placement that correlates to the lowest resistance level, the exerciser places the feet in the openings proximate to the indicia indicating "easy", the position approximately aligned with the dotted line 112. The exerciser's hands are gripping a gripping surface 701 on the stationary platform 105, representing the starting position for a certain exercise. To perform the exercise, commonly referred to in the industry as a Mountain Climber, the exerciser will push the hands and feet apart so that the feet, and correspondingly the slidable carriage will move towards the second stationary platform 106 with a force F=1 sufficient to overcome the resistance of the spring biasing means.

Figure 7B:
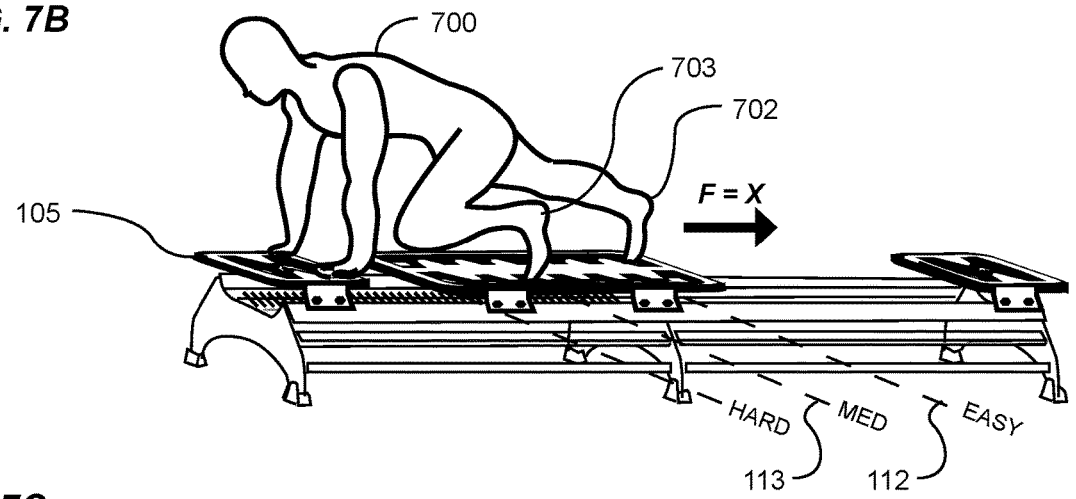

FIG. 7B is an exemplary diagram showing the exerciser 700 changing the foot position of the left foot 703 from the starting position of FIG. 7A, to a new position on a carriage. As will be appreciated. When the right leg and foot 702 is fully extended, the carriage would have moved to its maximum distance from the stationary platform 105 based on the exerciser exhausting his physical range of motion. At the position of the carriage as just described, the maximum spring resistance will be F=X, based on Hooke's Law. However, by repositioning the left foot 703 closer to a foot position on the carriage that is closer to the first stationary platform 105, the left foot position aligning substantially with the indicia indicating a higher resistance along the "med", or medium resistance dotted line 113, the exerciser can move the carriage further from the first stationary platform 105, thereby increasing the spring extension, and correspondingly, the resistance level.

Figure 7C:
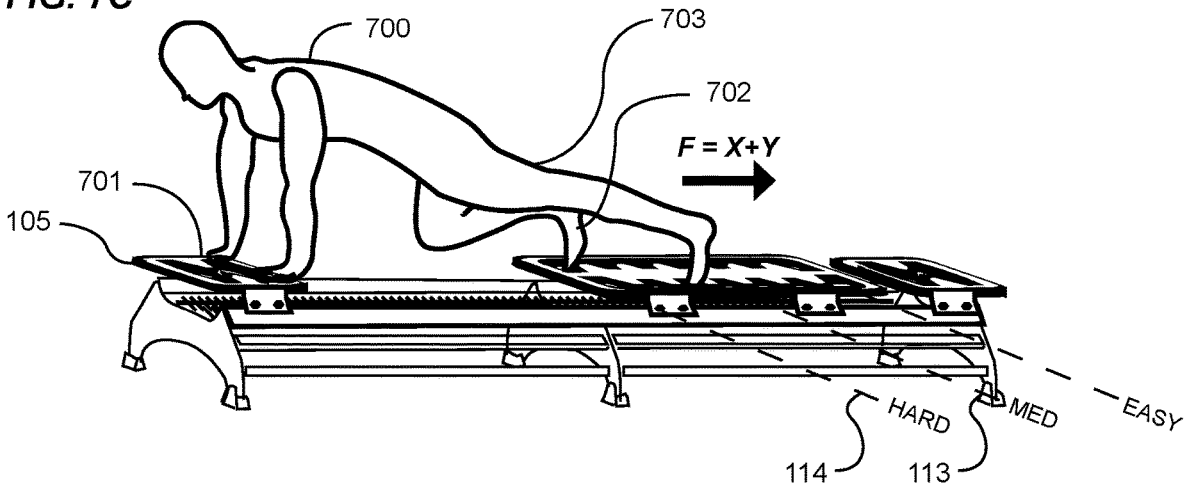

FIG. 7C is an exemplary diagram showing the exerciser 700 changing the foot position of the right foot 702 from the starting position of FIG. 7A, to a new position on a carriage. As will be appreciated, when the left leg and foot 702 are fully extended, the carriage would have moved to its maximum distance from the stationary platform 105 based on the exerciser exhausting his physical range of motion. In a scenario wherein the exerciser instantly desired a higher exercise resistance level, he would move his right foot 702 to a new position on the carriage most proximate to the stationary first platform 105, the new position being approximately aligned with the indicia appearing on the carriage as previously described, and substantially aligned with the "hard" resistance position indicated by the dotted line 114, maximizing the carriage's range of motion, and correspondingly, maximizing the spring resistance force F=X+Y based on Hooke's Law.

As can be appreciated, the exercise just described FIGS. 7A-7C emulate the motion of climbing a mountain by moving the feet and legs as is "walking up" a mountain by inserting the feet into the spaces formed between the laterally projecting surfaces as previously describe, the sequence progressing from the indicia correlating to the dotted lines indicating easy 112, med 113, and hard 114. In the return motion, the exerciser would "walk back down" the mountain by reversing the foot positioning just described until the feet were at the starting point as shown in FIG. 7A. The entire cycle just described is defined as a single repetition, with an exercise routine typically calling for repeating the repetition a number of times in sequence, for example, ten repetitions.

Figure 8A:
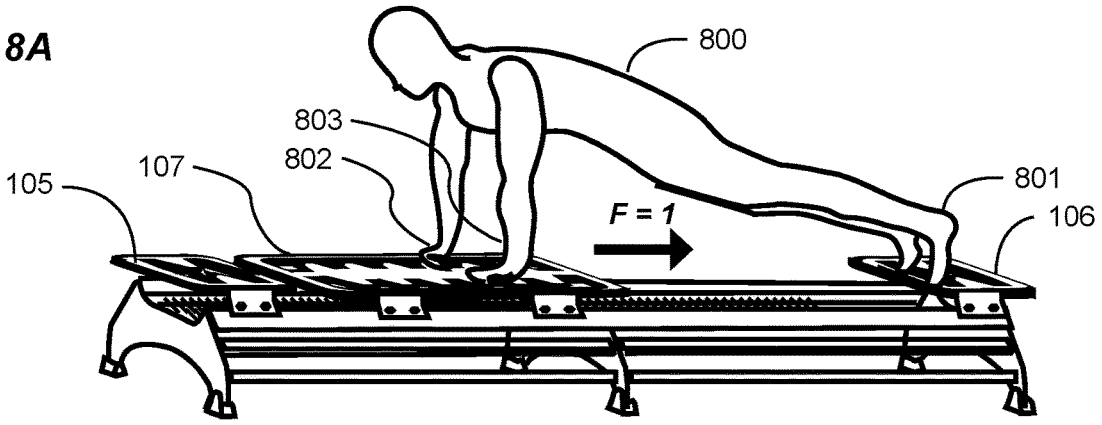
FIGS. 8A-8C are perspective views showing variable hand positions on a slidable platform or carriage in accordance with an example embodiment.

FIG. 8A is an exemplary diagram showing the hand position on a carriage at the start of an exercise. In this exercise, workout emphasis is placed on the core abdominal and upper body pectorals and deltoids, and secondarily work the lower back and legs. This exercise would emulate a person climbing a ladder by pulling themselves up using only their arms.

Therefore, at the starting position, the exerciser's feet are placed into the openings of the second platform 106 so that they remain locked in place to allow the exerciser to pull against the platform. The hands 802, 803 are placed on the gripping surface projections of the carriage 107 as previously described. Springs attached between the carriage 107 and the first end of the apparatus near the first stationary platform 105 provide a resistance biasing force F=1 against which the exerciser must pull against in order to move the carriage towards his feet.

Figure 8B:
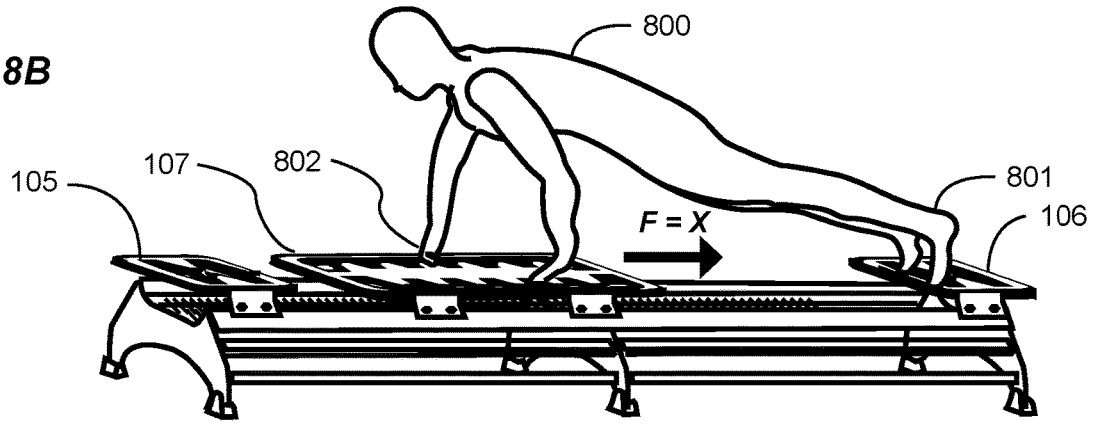

FIG. 8B is an exemplary diagram showing the right hand 802 of an exerciser 800 moving from the starting position just described to a new position on a carriage, specifically grasping a new gripping surface on a protrusion on the carriage closer to the first end of the apparatus than the gripping surface of the starting position. The feet 801 remaining positioned within the openings of the second stationary platform 106 provide for the exerciser to continue to pull the carriage closer to the second platform by overcoming the increased spring bias resistance with increased work F=X. Following Hooke's Law, as the slidable carriage is moved closer to the second stationary platform, the increasing distance requires the exerciser to exert a correspondingly increased force.

Figure 8C:
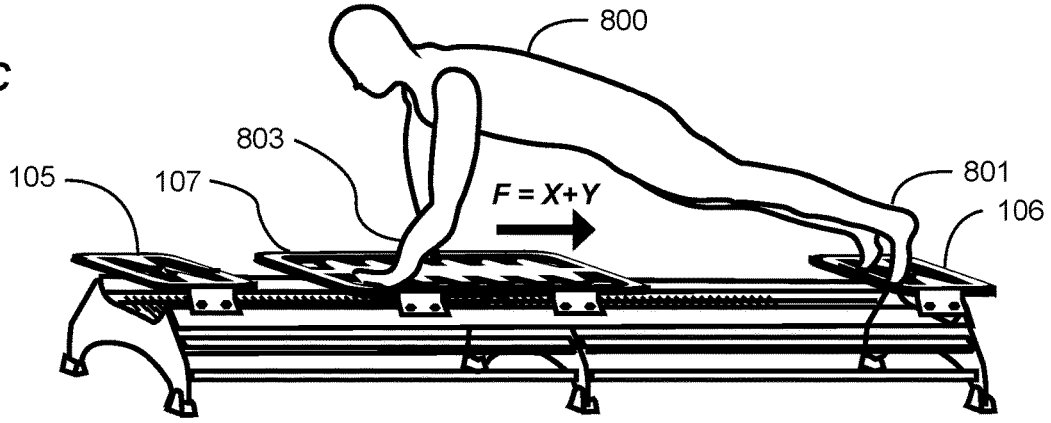

FIG. 8C is an exemplary diagram showing the left hand 803 of an exerciser 800 moving from the starting position of FIG. 8A to a new position on a carriage, specifically grasping a new gripping surface on a protrusion on the carriage closer to the first end of the apparatus than the gripping surface of the starting position. The feet 801 remaining positioned within the openings of the second platform 106 provide for the exerciser to continue to "climb" the carriage 107 by incrementally grasping the gripping surfaces increasingly closer to the first stationary platform 105.

In the scenario just described, the exerciser can increase the resistance level to the maximum desired resistance my incrementally changing the hand positions to the adjacent gripping surface until the desired resistance is attained.

As can be appreciated, the exercise just described FIGS. 8A-8C emulate the motion of climbing a ladder by pulling themselves up the ladder using only their arms. In the return motion, the exerciser would "climb back down" the ladder by reversing the hand positioning just described until the hands were at the starting point as shown in FIG. 8A. The entire cycle just described is defined as a single repetition, with an exercise routine typically calling for repeating the repetition a number of times in sequence, for example, ten repetitions.

Figure 9A:
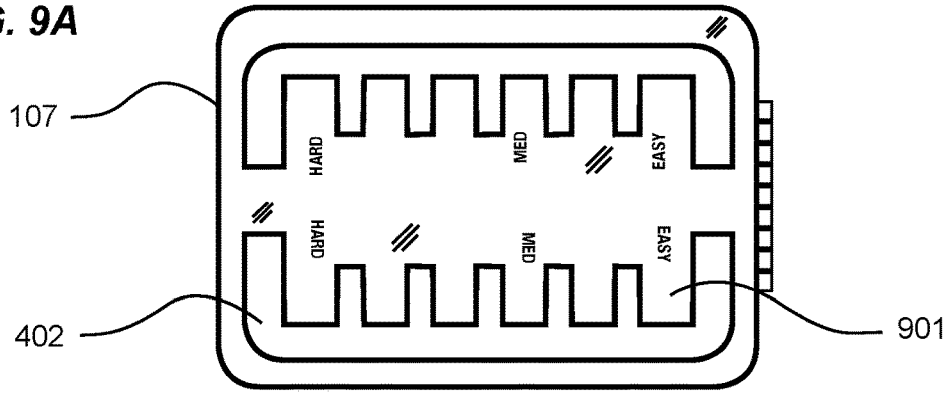
FIGS. 9A-9F are top views illustrating various example embodiments of the sliding platform or carriage.

FIG. 9A is an exemplary diagram showing a first variation of exerciser engaging positions on a carriage 107. In the variation, the top surface of a carriage 107 is shown with one substantially open space 402 on each side of the platform, with the portion of the platform between lateral edge of the open space and the lateral edge of the platform forming a longitudinal gripping handle. The medial edge of the open space is castellated, thereby creating an alternating series of open spaces and interstitial laterally projecting portions 901 of the platform, the open spaces between the laterally projecting portions providing for the insertion of an exerciser foot, and/or to allow for the insertion of an exerciser hand for gripping. In the variation just described, the open spaces and lateral projections are formed to provide for substantially rectilinear projections.

Figure 9B:
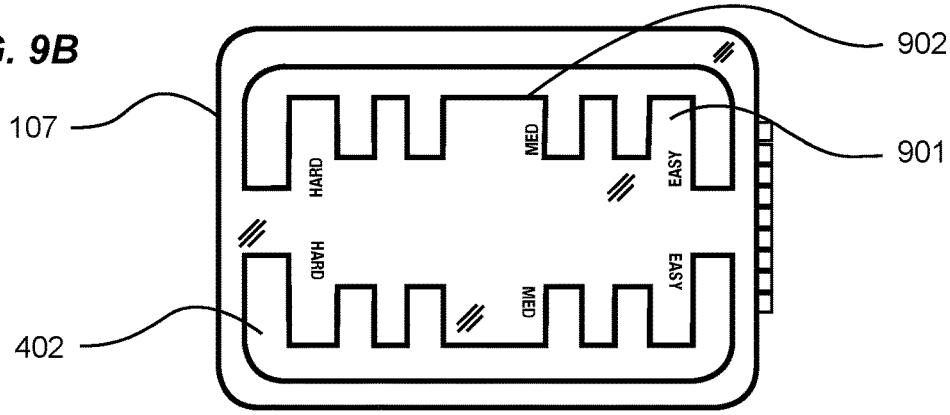

FIG. 9B is an exemplary diagram showing a second variation of exerciser engaging positions on a carriage 107. In the variation, the top surface of a carriage 107 is shown with one substantially open space 402 on each side of the platform, with the portion of the platform between lateral edge of the open space and the lateral edge of the platform forming a longitudinal gripping handle. It may be preferred to limit the number of laterally projections on the opposed sides of the platform. In the drawing, one variation is shown with a substantially lengthened lateral projection 902 on both sides of the platform, eliminating the potential for an exerciser to insert a foot, or grip a projection located substantially at the midpoint of the platform.

Figure 9C:
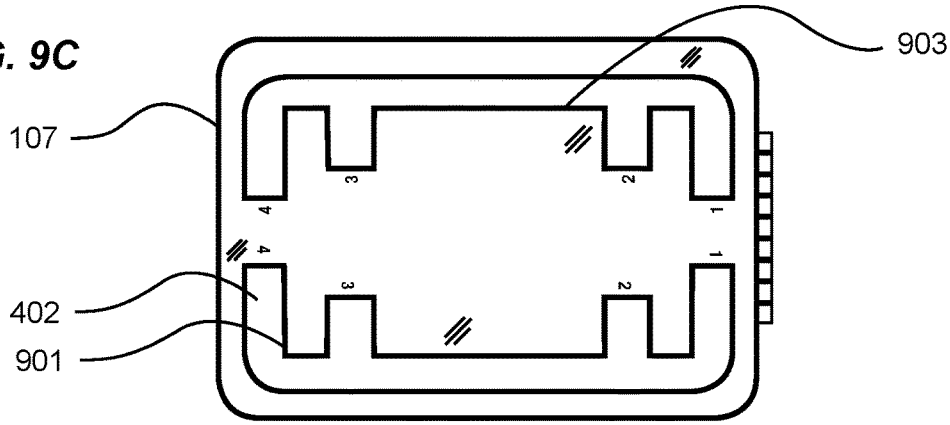

FIG. 9C is an exemplary diagram showing a third variation of exerciser engaging positions on a carriage 107. It may sometimes be preferred to limit the number of laterally projections of an carriage to only one on each of the opposed sides of the opposed ends of a platform. In the drawing, another variation is shown with a substantially lengthened central projection 903 on both sides of the platform, leaving only a single projection on each side of each end to insert a foot, or grip with a hand.

Figure 9D:
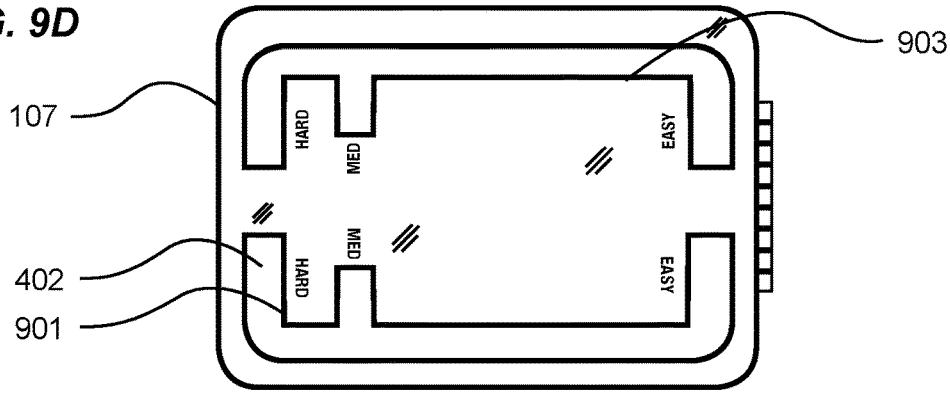

FIG. 9D is an exemplary diagram showing a fourth variation of exerciser engaging positions on a carriage 107. It may sometimes be provide for a perimeter gripping surface on the perimeter of each side of a carriage, the gripping surface formed by creating an open space 402 in a platform. In the drawing, another variation of the open space geometry is shown providing only one laterally projecting gripping surface 402 on each side of only one end of a carriage.

Figure 9E:
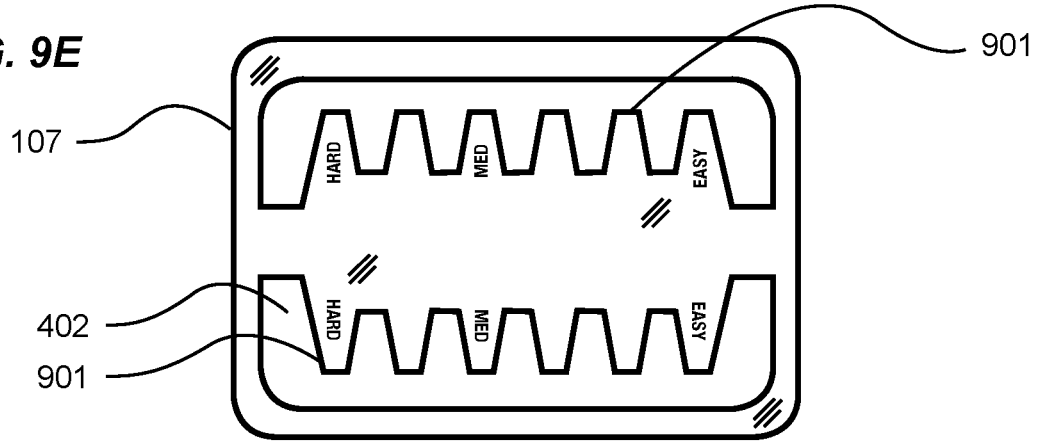
Figure 9F:
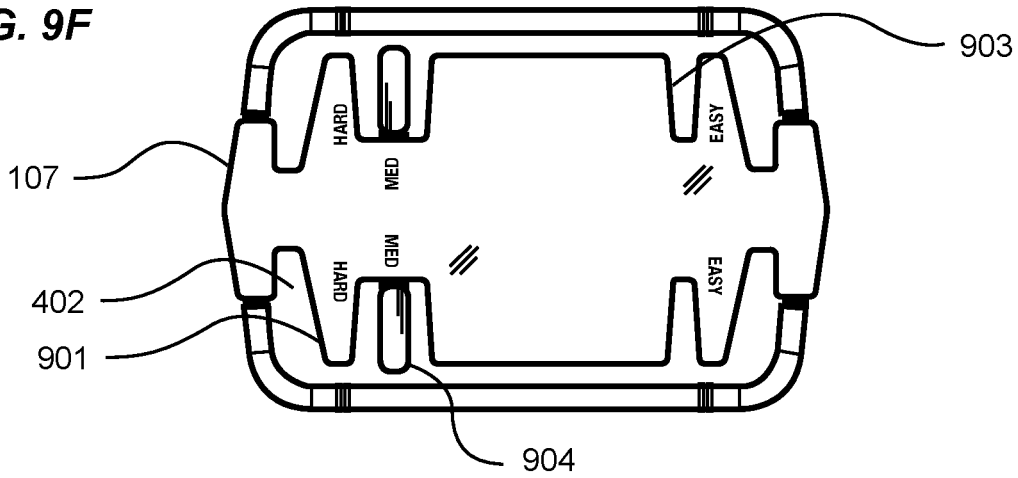

FIG. 9E illustrates another embodiment showing a saw tooth design for the projections 901 that form the opposing handles for the exerciser to engage with their left and right hands (or left and right feet). The projections 901 preferably have a tapered design with a blunt end but may have various other shapes and configurations. The projections 901 may also have a flat upper surface and a flat lower surface that are substantially parallel to one another. The projections 901 preferably are consistent in length, size and shape as shown in FIG. 9E, however, different lengths, sizes and shapes for the projections 901 may be used. For example, FIG. 9F illustrates another example embodiment that combines different lengths, sizes and shapes for the projections 901, 904. As shown in FIG. 9F, at least one pair of projections 904 have a cylindrical shape wherein the cross sectional shape is oval or circular for providing an ergonomic handle structure for the exerciser's hands. The projections 901 further are preferably equidistantly spaced apart, however, the projections 901 may be distally spaced apart at varying distances. It is preferable that the distance between projections 901 is mirrored on both sides of the carriage 107 as illustrated in FIGS. 9A through 9F of the drawings, however, the projections 901 do not have to mirror one another on the left and right sides.

It should be noted that indicia as previously described herein is shown on each of the variations of the carriage as just described. However, the number and sizes of the laterally projecting gripping surfaces, the indicia that may be used to identify one or more gripping surfaces, and the rectilinear geometry of the gripping surfaces are not meant to be limiting. A substantial number of combinations of size, indicia, placement and geometry of gripping surfaces may be implemented, but to illustrate each and every possible combination would be burdensome. Nevertheless, to do so would reinforce the non-limiting description of lateral projections for gripping, indicia and geometry.

As shown in FIGS. 1 through 3 of the drawings, the exercise machine includes a frame having a first end, a second end and at least one rail extending between the first end and the second end. A carriage is movably positioned upon the rail of the frame, wherein the carriage is movable between the first end and the second end. The carriage is comprised of an upper surface, a first end, a second end opposite of the first end of the carriage, a first side and a second side opposite of the first side, wherein the first end of the carriage is closer than the second end of the carriage to the first end of the frame. The carriage further includes a plurality of left projections distally spaced apart, wherein the plurality of left projections are adapted to be grasped by a left hand of an exerciser, The innermost of the plurality of left projections is closer to the first end of the frame than the outermost of the plurality of left projections. The carriage further includes a plurality of right projections distally spaced apart, wherein the plurality of right projections are adapted to be grasped by a right hand of an exerciser. The innermost of the plurality of right projections is closer to the first end of the frame than the outermost of the plurality of right projections. A spring is connected between the carriage and the frame that applies a bias force upon the carriage. The bias force applied to the carriage by the spring is based at least in part on the position of the carriage with respect to the first end of the frame. The exercise machine further includes a first end platform connected to the frame and positioned near the first end of the frame. The exercise machine further includes a second end platform connected to the frame and positioned near the second end of the frame. The carriage, the first end platform and the second end platform each may have an upper surface that is aligned on or adjacent a common plane as illustrated in FIG. 3 of the drawings.

The plurality of left projections may mirror the plurality of right projections as illustrated in the various embodiments shown in the figures. The plurality of left projections and the plurality of right projections may extend outwardly from a central portion of the carriage as illustrated in FIGS. 1, 2, 4 and 9A-9F of the drawings. Alternatively, the plurality of left projections may extend inwardly from a left perimeter portion of the carriage and the plurality of right projections extend inwardly from a right perimeter portion of the carriage. The left projections may connect to both the left perimeter portion and the central portion of the carriage with openings between each of the left projections. The right projections may connect to both the right perimeter portion and the central portion of the carriage with openings between each of the right projections.

The plurality of left projections and the plurality of right projections may be tapered and more specifically may taper to a distal portion thereof as illustrated in FIG. 9E of the drawings. The distal end of the plurality of left projections and the plurality of right projection is blunt as shown in FIGS. 9A through 9F of the drawings. The plurality of left projections and the plurality right projections each may have an upper surface that is on a common plane.

The plurality of left projections and the plurality of right projections may have a saw tooth structure as illustrated in FIGS. 1 through 5 and 9E of the drawings. The plurality of left projections each may have a consistent shape and size. The plurality of right projections each may have a consistent shape and size.

In one embodiment, the carriage includes a left opening surrounding a portion of the plurality of left projections and a right opening surrounding a portion of the plurality of right projections. The left opening and the right opening are each are elongated in an example embodiment. The left opening and the right opening each may have a saw tooth configuration as illustrated in the embodiment shown in FIG. 9E of the drawings.

The carriage includes a plurality of left pockets within the upper surface that define the plurality of left projections and a plurality of right pockets within the upper surface that define the plurality of right projections. The left pockets and the right pockets preferably mirror one another and each have a tapered configuration as shown in FIG. 5 of the drawings.

In another embodiment, the first end platform includes an opening defining a first projection and a second projection opposite of the first projection. The outer perimeter of the first end platform also may form one or more handles for an exerciser to engage with their hands and/or feet during an exercise. In another embodiment, the second end platform includes an opening defining a first projection and a second projection opposite of the first projection. The outer perimeter of the second end platform also may form one or more handles for an exerciser to engage with their hands and/or feet during an exercise. In one embodiment, the opening within the first end platform and the second end platform each is comprised of a first broad portion, a second broad portion and a narrow portion. The narrow portion connects the first broad portion to the second broad portion, wherein the first broad portion and the second broad portion each have a longitudinal axis that is transverse with respect to a longitudinal axis of the frame forming an I-shaped structure and at least two projections extending inwardly.

To adjust the bias force applied by the one or more springs 108 to the carriage the exerciser grasps a first set of projections of the carriage. The first set of projections are comprised of a first left projection from the plurality of left projections and a first right projection from the plurality of right projections. The first set of projections have a first distance from the first end of the platform. The exerciser then pushes the carriage away from the first end of the frame towards the second end of the frame (with their feet or legs on the first end platform), wherein the bias force applied by the spring is at a first level when the exerciser is fully extended. After returning the carriage back to near the first end of the exercise machine, the exerciser then grasps a second set of projections of the carriage. The second set of projections is comprised of a second left projection from the plurality of left projections and a second right projection from the plurality of right projections. The second set of projections have a second distance from the first end of the platform, wherein the second distance is less than the first distance. The exerciser then pushes the carriage away from the first end of the frame towards the second end of the frame, wherein the bias force applied by the spring is at a second level when the exerciser is fully extended (with their hands grasping the second set of projections). The second level is greater than the first level for the bias force thereby allowing the exerciser to increase the resistance force by merely repositioning their hands on the carriage in a different location. The exerciser is able to continue adjusting the resistance force applied to the carriage by adjusting which of the projections on the carriage that the exerciser engages with their body and/or adjusting which of the projections on the end platform that the exerciser engages with their body.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine resistance adjustment system, suitable methods and materials are described above. All publications, patent applications, patents, and other references mentioned herein are incorporated by reference in their entirety to the extent allowed by applicable law and regulations. The exercise machine resistance adjustment system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a first end and a second end;

a carriage movably positioned upon the frame, wherein the carriage is comprised of an upper surface, a first end, and a second end opposite of the first end of the carriage, wherein the first end of the carriage is closer than the second end of the carriage to the first end of the frame;

a first stationary end platform connected to the frame and positioned near the first end of the frame, wherein the first stationary end platform includes an upper surface; and wherein the first stationary end platform is comprised of an inner end, an outer end opposite of the inner end of the first stationary end platform, a first side extending between the inner end and the outer end of the first stationary end platform, and a second side extending between the inner end and the outer end of the first stationary end platform, wherein the second side of the first stationary end platform is opposite of the first side of the first stationary end platform, wherein the inner end of the first stationary end platform is closer to the first end of the carriage than the outer end of the first stationary end platform;

wherein the first stationary end platform includes a first handle, wherein the first handle is between the inner end of the first stationary end platform and the outer end of the first stationary end platform, wherein the first handle is between the first side of the first stationary end platform and the second side of the first stationary end platform, wherein the first handle is closer to the first side of the first stationary end platform than the second side of the first stationary end platform;

wherein the first stationary end platform includes a second handle, wherein the second handle is between the inner end of the first stationary end platform and the outer end of the first stationary end platform, wherein the second handle is between the first side of the first stationary end platform and the second side of the first stationary end platform, wherein the second handle is closer to the second side of the first stationary end platform than the first side of the first stationary end platform;

wherein the first handle is created by a first inner opening and a first outer opening, wherein the first inner opening is closer to the inner end of the first stationary end platform than the outer end of the first stationary end platform, and wherein the first outer opening is closer to the outer end of the first stationary end platform than the inner end of the first stationary end platform.

2. The exercise machine of claim 1, wherein the first handle and the second handle are centrally positioned between the inner end of the first stationary end platform and the outer end of the first stationary end platform.

3. The exercise machine of claim 2, wherein the first handle and the second handle are aligned transverse with respect to a longitudinal axis of the frame.

4. The exercise machine of claim 1, wherein the first handle and the second handle are aligned transverse with respect to a longitudinal axis of the frame.

5. The exercise machine of claim 1, wherein the first handle mirrors the second handle.

6. The exercise machine of claim 1, wherein the first handle is a laterally projecting structure extending inwardly from the first side of the first stationary end platform, and wherein the second handle is a laterally projecting structure extending inwardly from the second side of the first stationary end platform.

7. The exercise machine of claim 1, wherein the second handle is created by a second inner opening and a second outer opening, wherein the second inner opening is closer to the inner end of the first stationary end platform than the outer end of the first stationary end platform, and wherein the second outer opening is closer to the outer end of the first stationary end platform than the inner end of the first stationary end platform.

8. The exercise machine of claim 7, wherein the first handle is a laterally projecting structure extending inwardly from the first side of the first stationary end platform, and wherein the second handle is a laterally projecting structure extending inwardly from the second side of the first stationary end platform.

9. The exercise machine of claim 7, wherein the first inner opening, the second inner opening, the first outer opening and the second outer opening are connected together by a narrow opening extending between the first handle and the second handle.

10. The exercise machine of claim 9, wherein the first inner opening, the second inner opening, the first outer opening, the second outer opening and the narrow opening form an I-shaped opening.

11. The exercise machine of claim 1, wherein the first handle and the second handle are each tapered.

12. The exercise machine of claim 11, wherein the first handle and the second handle each taper to an interior portion thereof.

13. The exercise machine of claim 1, wherein the first handle has a first upper surface and the second handle has a second upper surface, wherein the first upper surface and the second upper surface are flat.

14. The exercise machine of claim 13, wherein the first upper surface, the second upper surface and the upper surface of the first stationary end platform are all on a common plane.

15. An exercise machine, comprising:

a frame having a first end and a second end;

a carriage movably positioned upon the frame, wherein the carriage is comprised of an upper surface, a first end, and a second end opposite of the first end of the carriage, wherein the first end of the carriage is closer than the second end of the carriage to the first end of the frame;

a first stationary end platform connected to the frame and positioned near the first end of the frame, wherein the first stationary end platform includes an upper surface; and wherein the first stationary end platform is comprised of an inner end, an outer end opposite of the inner end of the first stationary end platform, a first side extending between the inner end and the outer end of the first stationary end platform, and a second side extending between the inner end and the outer end of the first stationary end platform, wherein the second side of the first stationary end platform is opposite of the first side of the first stationary end platform, wherein the inner end of the first stationary end platform is closer to the first end of the carriage than the outer end of the first stationary end platform;

wherein the first stationary end platform includes a first handle, wherein the first handle is between the inner end of the first stationary end platform and the outer end of the first stationary end platform, wherein the first handle is between the first side of the first stationary end platform and the second side of the first stationary end platform, wherein the first handle is closer to the first side of the first stationary end platform than the second side of the first stationary end platform;

wherein the first stationary end platform includes a second handle, wherein the second handle is between the inner end of the first stationary end platform and the outer end of the first stationary end platform, wherein the second handle is between the first side of the first stationary end platform and the second side of the first stationary end platform, wherein the second handle is closer to the second side of the first stationary end platform than the first side of the first stationary end platform;

wherein the first handle and the second handle are centrally positioned between the inner end of the first stationary end platform and the outer end of the first stationary end platform;

wherein the first handle and the second handle are aligned transverse with respect to a longitudinal axis of the frame;

wherein the first handle mirrors the second handle;

wherein the first handle is created by a first inner opening and a first outer opening, wherein the first inner opening is closer to the inner end of the first stationary end platform than the outer end of the first stationary end platform, and wherein the first outer opening is closer to the outer end of the first stationary end platform than the inner end of the first stationary end platform;

wherein the second handle is created by a second inner opening and a second outer opening, wherein the second inner opening is closer to the inner end of the first stationary end platform than the outer end of the first stationary end platform, and wherein the second outer opening is closer to the outer end of the first stationary end platform than the inner end of the first stationary end platform;

wherein the first handle has a first upper surface and the second handle has a second upper surface, wherein the first upper surface and the second upper surface are flat;

wherein the first upper surface, the second upper surface and the upper surface of the first stationary end platform are all on a common plane.

16. The exercise machine of claim 15, wherein the first handle is a laterally projecting structure extending inwardly from the first side of the first stationary end platform, and wherein the second handle is a laterally projecting structure extending inwardly from the second side of the first stationary end platform.

17. The exercise machine of claim 15, wherein the first inner opening, the second inner opening, the first outer opening and the second outer opening are connected together by a narrow opening extending between the first handle and the second handle.

18. The exercise machine of claim 17, wherein the first inner opening, the second inner opening, the first outer opening, the second outer opening and the narrow opening form an I-shaped opening.

19. An exercise machine, comprising:

a frame having a first end and a second end;

a carriage movably positioned upon the frame, wherein the carriage is comprised of an upper surface, a first end, and a second end opposite of the first end of the carriage, wherein the first end of the carriage is closer than the second end of the carriage to the first end of the frame;

a first stationary end platform connected to the frame and positioned near the first end of the frame, wherein the first stationary end platform includes an upper surface; and a second stationary end platform connected to the frame and positioned near the second end of the frame, wherein the second stationary end platform includes an upper surface;

wherein the first stationary end platform is comprised of an inner end, an outer end opposite of the inner end of the first stationary end platform, a first side extending between the inner end and the outer end of the first stationary end platform, and a second side extending between the inner end and the outer end of the first stationary end platform, wherein the second side of the first stationary end platform is opposite of the first side of the first stationary end platform, wherein the inner end of the first stationary end platform is closer to the first end of the carriage than the outer end of the first stationary end platform;

wherein the first stationary end platform includes a first handle, wherein the first handle is between the inner end of the first stationary end platform and the outer end of the first stationary end platform, wherein the first handle is between the first side of the first stationary end platform and the second side of the first stationary end platform, wherein the first handle is closer to the first side of the first stationary end platform than the second side of the first stationary end platform;

wherein the first stationary end platform includes a second handle, wherein the second handle is between the inner end of the first stationary end platform and the outer end of the first stationary end platform, wherein the second handle is between the first side of the first stationary end platform and the second side of the first stationary end platform, wherein the second handle is closer to the second side of the first stationary end platform than the first side of the first stationary end platform;

wherein the first handle mirrors the second handle;

wherein the first handle is created by a first inner opening and a first outer opening, wherein the first inner opening is closer to the inner end of the first stationary end platform than the outer end of the first stationary end platform, and wherein the first outer opening is closer to the outer end of the first stationary end platform than the inner end of the first stationary end platform;

wherein the second handle is created by a second inner opening and a second outer opening, wherein the second inner opening is closer to the inner end of the first stationary end platform than the outer end of the first stationary end platform, and wherein the second outer opening is closer to the outer end of the first stationary end platform than the inner end of the first stationary end platform;

wherein the first handle has a first upper surface and the second handle has a second upper surface, wherein the first upper surface and the second upper surface are flat;

wherein the first upper surface, the second upper surface and the upper surface of the first stationary end platform are all on a common plane.

20. The exercise machine of claim 19, wherein the frame includes at least one rail that the carriage is movably positioned upon.

* * * * *